US005609438A

United States Patent [19]

Liao

[11] Patent Number: 5,609,438

[45] **Date of Patent: *Mar. 11, 1997**

[54] FLOOD BARRIER AND A METHOD FOR FORMING A FLOOD BARRIER

[75] Inventor: Andrew Liao, Kingwood, Tex.

[73] Assignee: Baroid Technology, Inc., Houston, Tex.

[ * ] Notice: The term of this patent shall not extend beyond the expiration date of Pat. No. 5,454,668.

[21] Appl. No.: 508,003

[22] Filed: Jul. 27, 1995

Related U.S. Application Data

[63] Continuation of Ser. No. 248,798, May 25, 1994, Pat. No. 5,454,668.

[51] Int. Cl.[6] ..... E02B 7/06

[52] U.S. Cl. ..... 405/117; 405/109

[58] Field of Search ..... 405/52, 80, 107, 405/109, 116, 117, 114; 166/294

[56] References Cited

U.S. PATENT DOCUMENTS

| | | | |
|---|---|---|---|
| 1,507,868 | 9/1924 | Stubbs | 405/109 X |
| 3,188,814 | 6/1965 | Rettig | 405/109 |
| 3,385,068 | 5/1968 | Armentrout | 405/109 |
| 4,266,885 | 5/1981 | Naito et al. | 405/109 |
| 4,650,368 | 3/1987 | Bayer | 405/107 X |
| 4,834,579 | 5/1989 | Aris et al. | 405/109 |
| 5,065,822 | 11/1991 | Miller et al. | 405/52 X |
| 5,407,909 | 4/1995 | Goodhue, Jr. et al. | 507/118 |
| 5,454,668 | 10/1995 | Liao | 405/117 |

FOREIGN PATENT DOCUMENTS

| | | | |
|---|---|---|---|
| 170312 | 9/1984 | Japan | 405/116 |
| 641026 | 1/1979 | U.S.S.R. | 405/117 |

*Primary Examiner*—Randolph A. Reese
*Assistant Examiner*—John A. Ricci
*Attorney, Agent, or Firm*—Browning Bushman

[57] ABSTRACT

A trench is excavated from the top surface of an earthen dike, all the way down into the foundation below the base of the dike. Dry powder, partially hydrolyzed polyacrylamide (PHPA) is mixed with fresh water and soda ash in proportions of 20 lbs PHPA, to 4 lbs of soda ash, to 68 barrels of fresh water (2856 gallons) to form a slurry having a funnel viscosity of at least 45 sec/quart. As the trench is being excavated, the slurry is pumped into the trench immediately. A section of geo-membrane having a thickness of 0.080" is placed in the trench all the way to the bottom of the trench, overlapping at the top of the membrane onto the top surface of the dike. Dry sand is then pumped into the trench to displace the slurry in the trench.

19 Claims, 2 Drawing Sheets

FLOOD BARRIER AND A METHOD FOR FORMING A FLOOD BARRIER

This is a continuation of application Ser. No. 08/248,798, filed May 25, 1994 now U.S. Pat. No. 5,454,668.

BACKGROUND OF THE INVENTION

This invention relates generally, to flood control, and specifically, to a new and improved flood barrier and to a method for forming such a barrier.

DESCRIPTION OF PRIOR ART

It has been known, perhaps since the beginning of time, to construct dikes, usually of dirt or earthen materials, to hold back or otherwise control flood waters. Such dikes, sometimes referred to as barriers, banks, levis or dams, have one major shortcoming. When the water becomes too high, it normally flows through or over the top of the barrier and reaches the area intended to be protected from the water.

It has been proposed in the known an to construct a recovery trench in the crest of the dike to receive the water spilling over the top of the barrier, and having received the water, to transport it to some remote location.

However, such a trench, to be effective, should have a high volume capacity, perhaps fifty feet deep, while not being very wide, perhaps two feet wide.

Existing dikes, commonly referred to as the Reach 11 Dikes at the Heyden/Rhodes Aqueduct, north of Phenix, Ariz., about 15 miles long, were constructed from 1974 to 1977 to protect the aqueduct and to drain flood water. Since construction, the dikes have experience transverse crating, possibly due to pounding water behind the dikes that saturate dispersive soils in the dikes foundation and lead to foundation settlement. There has been a concern that pounding behind the dikes coupled with a compromised foundation could result in the ultimate failure of the dikes and possible downstream flooding.

As would be expected, a fifty-foot trench, two feet wide, dug into a dirt barrier or dike, is not stable. It has to be protected from caving in during its excavation, and ultimately hold a substance such a and which will recover water spilled through or over the top of the dike. Conventionally, the bentonite clay base slurries including high yield sodium bentonite slurry described in U.S. Pat. Nos. 4,582,453 (1986) and 4,900,195 (1990), or the excavated soil-bentonite slurry described in U.S. Pat. Nos. 4,696,607 (1987) and 4,714,379 (1987), or the cement-bentonite or concrete slurry described in U.S. Pat. No. 4,601,615 (1986) have been commonly used as supporting fluids to fill and stabilize the trench or earthen cavities. However, the supporting slurries cited above, which are effective for the construction of an impermeable trench and a slurry cut-off wall for protecting the environment from contaminants, are not suitable for the construction of a recovery trench for drainage, because none of the above slurries are solid free and it is difficult to keep a sand filter medium from contaminating with solids in the remaining supporting slurry after displacement.

U.S. Pat. No. 4,863,312 describes the use of a biodegradable polymer slurry for the construction of a leachate and pollutant drainage barrier system which is formed by excavating a narrow slit or slot in the earth. The supporting slurry changes from a highly viscous character after a predetermined period of time (approximately 5 to 7 days) needed to maintain the trench with a permeable fill, such as gravel, etc.

After the fill has provided by the fill material, the slurry reverts to a liquid having a substantially lower viscosity which may be drained via the drain pipe in the bottom of the trench. The biodegradable polymer slurry is commonly prepared from the water-soluble gums such as guar gum which is found in the seed of two annual leguminous plants. Guar gum after being hydrated in water, forms a viscous colloidal dispersion which is a thixotropic rheological system. Unfortunately, the gum slurry will ferment in a short period - from three hours to three days depending upon the climate and environment. Once the gum slurry is fermented, it loses its thixotropic property and viscosity due to "spontaneous depolymerzation" of gum molecules.

OBJECTS OF THE INVENTION

It is therefore an objective of the present invention is to provide a new and improved aqueous solution as a slurry for keeping the trench wall from caving in during the construction of a recovery trench for drainage.

Another objective of the present invention is to provide a new and improved method of stabilizing the trench wall during the construction of a recovery trench.

Still, a further objective of the present invention is to provide a nontoxic, non-fermenting and highly viscous slurry for the construction of a recovery trench, a slurry having thermal stability even in an extreme hot climate, without losing its viscosity.

Yet another object of the invention is to provide a new and improved drainage trench having first a highly viscous slurry, and then a sand filter medium having essentially no slurry remaining therein.

SUMMARY OF THE INVENTION

These and other objects, features and advantages of the present invention are accomplished, generally, by a process which excavates a trench in the top surface of an earthen dike, which fills the excavated trench with a slurry made by mixing dry PHPA and fresh water, and which then displaces the slurry with sand.

The invention also contemplates the additional process step of placing a geo-membrane in the slurry-filled trench prior to adding the sand.

BRIEF DESCRIPTION OF THE DRAWINGS

Other features and intended advantages of the invention will be more readily apparent by reference to the following detailed description in connection with the accompanying drawings, wherein.

Figure 1:
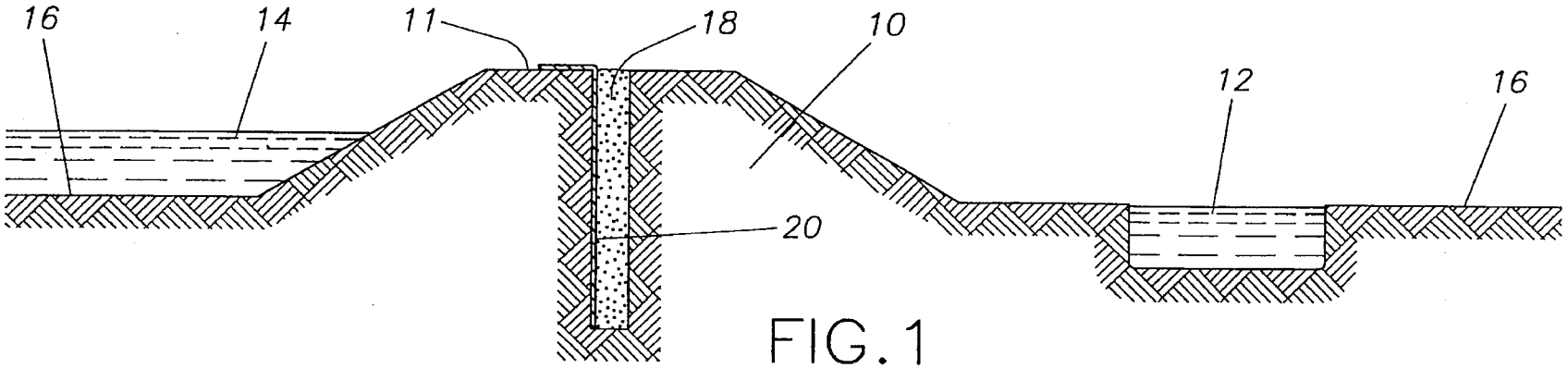
FIG. 1 is an elevational, cross-sectional, schematic end view of a dike used to protect a canal from flood waters in accordance with the present invention.

While the invention will be described in connection with a presently preferred embodiment, it will be understood that it is not intended to limit the invention to that embodiment. On the contrary, it is intended to cover all alternatives, modifications and equivalents as may be included within the spirit of the invention as defined in the appended claims.

DETAILED DESCRIPTION OF THE PREFERRED EMBODIMENT

Industrial gums such as guar gum have been used as a slurry to keep a trench open because gum slurries can develop high viscosity. However, biocides or preservatives are usually added to the gum slurry to prevent the gum from fermentation, particularly in summer climate. Once the gum slurry is fermentated, the slurry loses its viscosity and becomes a water-thin fluid which will not keep a trench stable enough to prevent the trench from caving in during the construction. In order to overcome the drawbacks of gum slurry a polymer slurry prepared from a dry solid, partially hydrolyzed polyacrylamide (PHPA) polymer is used in accordance with the present invention as the slurry for the construction. The dry PHPA polymer used for the present invention was selected from several PHPA polymers commercially available on the market. The detail selection process is described in Example 1.

A PHPA polymer known in the drilling mud art has been used for many years in water-based mud systems commercially available to the oil/gas industry, because the fluid provides cuttings and borehole stability. However, to the best of the applicant's knowledge, a solid-free PHPA polymer aqueous slurry has never been applied as a supporting fluid for the construction of a recovery trench.

A small amount of dry PHPA polymer can provide a clear, viscous, aqueous solution because PHPA molecules, when in contact with freshwater, hydrate immediately. The effective size of a PHPA molecule in an aqueous solution is much larger than the actual molecular size. The water molecules surrounding a polymer molecule become part of the polymer unit. The volume of a hydrated PHPA molecule is called the hydrodynamic volume. The larger the hydrodynamic volume a PHPA molecule has, the higher the slurry viscosity becomes. Hydrodynamic volume is dependent on intrinsic viscosity and the molecular weight distribution of the polymer. The PHPA polymer used for the present invention has a molecular weight high enough to develop a very viscous slurry. For example a 0.12% by weight of dry polymer can provide a slurry with a funnel viscosity of 70 seconds per quart. A 0.17% by weight of the polymer slurry shows a funnel viscosity of 80 seconds per quart.

Once the PHPA polymer is hydrated in freshwater, the hydrated molecules absorb onto excavated solid particles and onto the surface of the trench wall, thereby forming a stationary, thin coating. This coating prevents excavated solid particles from dispersing and protects the trench wall from sloughing, which further provides stability to the trench. Absorption characteristics of PHPA polymer is described in an article entitled "Adsorption Characteristics of PHPA on Formation Solids, " Liao and Siems, presented at the 1990 IADC/SPE Drilling Conference hold in Houston, Tex. (March, 1990). The article indicates that the adsorption characteristic of a hydrated PHPA polymer onto solids is strongly dependent on the specific surface area accessible and the nature of the solids. This study showed swellable clay or cuttings adsorbed more hydrated PHPA polymers than non-swellable cuttings. The word "swellable", in general, refers to the solids which contain more smectite and kaolinite and less illite. The swellable solids include active soil, shale, and sodium bentonite clay etc. Sand consisting of quartz and illite soil and shale are non-swellable solids. In accord with the present invention, the hydrated PHPA polymers adsorb to the excavated solids more than to the sand particles used to fill the trench.

A field test was conducted on site to evaluate guar gum and PHPA polymer slurries side by side. One trench was filled with a guar gum slurry prepared by mixing 150 pounds guar gum with 3000 gallons of freshwater, and another trench was filled with the PHPA polymer slurry prepared by mixing 35 pounds Baroid EZ MUD DP through a hopper with 3000 gallons of freshwater. The rate of addition was approximately 14 pounds of dry polymer per minute. Agitation of the polymer slurry in tile mixing tank was provided by two large paddles rotating at a speed of 1000 to 2000 rpm. Mixing continued for about 15 minutes to allow the PHPA polymers to fully hydrate. Viscosity of both slurries was measured using a standard Marsh Funnel Viscometer before filling the trenches with the sand filter medium. Guar gum slurry showed a funnel viscosity of 49 seconds per quart and the PHPA slurry had funnel viscosity of 56 seconds per quart. Three hours after the trenches were filled with the respective slurries, the guar gum slurry without addition of any biocide or preservative started to decay or degraded enzymically because the local temperature reached 115° F. The top of the trench was covered with black mold-like lumps and the slurry began to lose its viscosity due to the biodegradation of guar gum molecules. There was no apparent change in the PHPA polymer slurry. The next day after a prototype trench was constructed with the slurry containing 0.12% by weight of PHPA dry polymer, the trench was cut open to examine the uniformity of the sand filter medium. No apparent straits of sand were detected visually.

Another advantage of using the PHPA slurry is that the remaining polymer solution, if there is any, can be biodegraded within a reasonable time period or can be immediately degraded chemically with a dilute sodium hypochlorite solution (bleach). The decomposed by-products, which can be easily pumped out of the trench for disposal, typically do not harm marine life or the environment.

EXAMPLE

There are many types of PHPA polymer products in both solid and liquid form in the commercial market. However, the preferred solid PHPA polymer used for the invention has the following characteristics: (1) easily dispersed in freshwater without forming fish-eyes or lumps, (2) readily hydrolyzed in freshwater to develop sufficient viscosity with minimum polymer concentration, and (3) environmentally acceptable. The solid PHPA polymer used for the invention was selected stringently from an array of commercially available PHPA polymer products with the screening procedure described below to meet the above criteria.

The screening procedure proceeded in three phases. Phase 1 consisted of laboratory dispersibility tests which predicted the ability of a dry PHPA polymer to disperse relative to a known, easily disperable polymer. Phase 2 consisted of evaluating polymer performance such as ease of mixing and resultant fluid properties in a 50 barrel large scale mixing test.

Phase 1—Laboratory Dispersibility Test

The dispersibility test is based on the principle that interaction between PHPA polymer molecules and clay particles reaches an equilibrium within a certain time interval. A dispersive PHPA polymer takes less time to reach the equilibrium than the one which is difficult to disperse. If the adsorption of PHPA molecules on clay particles is interrupted by the addition of acid before the system reaches equilibrium, most of the PHPA polymer will be adsorbed on clay, while less dispersive PHPA polymer will remain in the liquid phase. The interruption of PHPA adsorption before it reaches equilibrium is commonly referred to as the "quench process". After the PHPA-clay slurry was quenched, the liquid phase was analyzed for unreacted PHPA concentration. For a PHPA polymer which is easy to disperse there should be very little unreactive PHPA polymer left in the liquid phase because most of the PHPA polymer is already dispersed and adsorbed on clay particles. For a difficult-to-disperse PHPA, there will be considerably more PHPA remaining in the liquid phase.

The analytical procedure used to determine PHPA concentration is based upon the fact that in an acetic acid and sodium acetate buffer solution, PHPA reacts with sodium hypochlorite (liquid bleach) to form an insoluble colloidal suspension of chloramides. The turbidity produced by this chemical reaction, which is proportional to the amount of PHPA present, can be measured using a spectrophotometer at 400 nm wavelength.

Four dry powder, commercially available PHPA polymers from different sources were tested for comparative dispersibility. The detailed procedure of the test is listed in sequence as follows: (1) prepare one barrel of clay slurry by placing 350 ml of deionized water in each mixing cup and begin stirring on a Multimixer, (2) slowly add 10 grams of laboratory standard sodium bentonite clay to each cup and shear for 20 minutes, (3) remove the slurries from the mixer and use a variable speed mixer set at 600 to 700 rpm to mix the slurry, (4) slowly sift 0.5 gram of dry powder PHPA polymer into the slurry while mixing and continue to stir for 15 minutes, (5) allow each polymer/bentonite slurry to set at ambient temperature for 30 minutes, (6) transfer by pipet 5 ml of the acetic acid-sodiumacetate buffer solution into a 50 ml glass bottle, (7) withdraw 20 ml of polymer/bentonite slurry while stirring at low speed and add to the glass bottle containing the buffer solution, (8) cap the bottle and shake vigorously (the polymer/bentonite slurry will solidify immediately upon contact with the buffer solution), (9) collect the clear fluid or decantate from the bottle, (10) transfer 5 ml of the clear solution into a spectrophotometer tube, (11) invert the tube several times and allow the mixture to set for 7 minutes to develop turbidity, if there is PHPA polymer present, (12) measure the transmittance of the mixture as compared to that of deionized water, (13) compare transmittance obtained from each polymer tested to determine ease of dispersion in freshwater.

The ranking for ease of dispersion in freshwater of the four dry powder PHPA polymers, with the name of the manufacture (or supplier), is listed as follows:

| Rank | PHPA polymer | Provider |
|---|---|---|
| 1 | Mon Paal | Montello |
| 2 | EZ MUD DP | Baroid |
| 3 | New Drill | Inteq |
| 4 | ASP-700 | Nalco |

Often the results obtained from a small scale test may not always agree with that from a larger scale test, therefore, the second phase test involves a larger testing scale.

Phase 2—A 50 Barrel Mixing Test

Phase 2 mixing test involved a 50 barrel capacity scale up. This phase evaluated tile dispersion characteristics of the dry powder PHPA polymer with field mixing equipment. All PHPA dry products were evaluated in a freshwater sodium bentonite slurry as a base slurry. The test was conducted at the Sperry-Sun MWD facility located in tile Houston Baroid complex. The field mixing equipment included a 80 barrel mud pit or tank, a triplex mud pump, and a flow loop with a hydraulic operated choke. Agitation in the mixing tank was provided by a Lighting mixer and a centrifugal pump.

The criteria used to evaluate dispersibility of each dry PHPA polymer in this mixing test were funnel viscosity using a standard Marsh Funnel viscomer, fluid rheological properties using a Farm 35A V-G meter, dispersibility, and filter cake quality by API (American Petroleum Institute) standard procedure. These properties were measured at specific times after addition of polymer to the base slurry. In addition, visual observation of PHPA polymer change in the mixing tank served as another important criterion. The visual observation looked for (1) the amount of undispersed dry polymer left on 1.6 mm and 20 mesh (0.925 mm) metal screens, and (2) the overall appearance of the mixture in the tank to see if large conglomerates of nondispersed polymer or fish-eyes were floating on the top of the slurry.

The funnel viscosity profile as a function of time for each polymer slurry was established for comparison. In the first 10 minutes mixing period each polymer exhibited a sudden increase of viscosity, defined as flash viscosity, then the viscosity gradually decreased as mixing continued. After the slurry was mixed for 20 minutes the funnel viscosity reached a constant. The polymer slurry which showed a low funnel viscosity profile and a small flash viscosity indicates the dry polymer is easier to disperse. Many conglomerates or fish-eyes formed by undispersed dry polymers were found in the slurry which also exhibited a high funnel viscosity profile and a high flash viscosity occurring in the early mixing period. The overall performance of the four dry PHPA polymers evaluated in the second phase were ranked as follows:

| Rank | PHPA polymer | Provider |
|---|---|---|
| 1 | EA MUD DP | Baroid |
| 2 | New Drill | Inteq |
| 3 | ASP-700 | Nalco |
| 4 | Mon Paal | Montello |

The dry polymer EZ MUD DP provided by Baroid was selected for the present invention after combining the results obtained from both phases of evaluation.

Toxicity Test of the Dry PHPA Polymer

The objective of the test was to determine the acute toxicity to Mysidopsis bahia neonates of the dry PHPA polymer used for the invention. The test was conducted according to methods specified by the U.S. Environmental Protection Agency. The tests were conducted at a water temperature of 20° C. The test organisms in the tests were exposed in 96-hour static nonrenewal definitive acute tests to six concentrations and one control. The control treatments in the tests utilized sanity-adjusted seawater brine. The test fluids were prepared by adding 8 pounds of the dry polymer into one barrel of generic mud #7 to make a 2.23% by weight of the polymer slurry. Ninety-six hours $LC_{50}$ was greater than 1,000,000 part per million (ppm). No effluent concentration produced 50% mortality in 96 hours. The dry PHPA polymer used for the invention is a non-toxic polymer which does not harm marine life or the environment.

After considerable field tests and laboratory tests of the process according to the present invention, the process was used in the beginning stages of construction of a drainage trench in the modification of the Reach 11 Dikes at the Hayden/Rhodes Aqueduct, North of Phoenix, Ariz.

The above and other objectives of the present invention will become apparent from the description given herein and the appended claims.

The polymer used to prepare the polymer slurry is a dry solid PHPA polymer with a 30% hydrolyzed polyacrylamide and a molecular weight ranging from 8 to 12 million. The polymer slurry used for recovery trench construction has a concentration range of 0.08% to 0.17% by weight or 20 pounds to 42 pounds per 3000 gallons of freshwater. Both forms of the polymer, dry solid and aqueous solution, are non-toxic, non-fermenting, and environmentally acceptable.

The PHPA polymer must be hydrated to develop a highly viscous slurry to provide a thin film to coat the trench wall and to encapsulate solid particles on the surface of trench wall, thus providing a stable trench wall. In the past, industrial gums such as guar gums have been used for a similar application. However, adsorption of hydrated PHPA polymer is more selective than that of the gums. The hydrated PHPA polymers attach to excavated solid particles much tighter than sand particles which are used to fill the trench as a sand filter medium. Therefore, during the construction where excavation and filling trench occurs simultaneously, most of the PHPA polymer is consumed by the excavated solid, not by tile sand that keeps the sand filter in its original integrity. Moreover, unlike most gums which have a branch or network molecular structure, PHPA polymer, a linear structural polymer, has no definite yield stress and does not suspend sand particles for a long duration. Because of that, the sand with varying particle size distribution can be settled in the trench quickly and homogeneously without creating any appreciable straits or bands due to uneven settlement of sand particles.

The advantages of the present invention of using a PHPA polymer aqueous solution as a slurry for the construction of a recovery trench include the following: (1) PHPA polymer slurry is non-fermenting, non-toxic, and highly viscous fluid with effective trench wall stabilization, (2) PHPA polymer slurry has no yield stress so that sand filter medium can settle quickly and homogeneously in the trench, (3) most of the hydrated PHPA polymers in the slurry adsorb on the excavated soil, not to the sand filter medium that keeps the sand filter in its original state, (4) the remaining PHPA polymer slurry can be biodegraded within a reasonable time period or immediately degraded chemically with a diluted bleach solution, and the decomposed by-products do not harm marine life or environment.

FIG. 1 illustrates, schematically, a dike 10 which has been constructed to protect canal 12 from the flood water 14. It should be appreciated that the ground level 16 may be desert, and that the water 14 may have resulted from flash flooding, as opposed to being a solid state, or constant condition. The dike 10 for which the present invention was developed is the Reach 11 Dike at the Hayden/Rhodes Aqueduct, North of Phoenix, Ariz., and the canal 12 corresponds to the Central Arizona Project Canal which extends into the Northeast sector of Phoenix. The dike was originally constructed between 1974 and 1977 to protect the canal 12 from pollution and some of the city of Phoenix from flooding.

In recent years, it has been discovered that the dike 10 has been cracking. The Bureau of Reclamation thus commenced a project to correct the problem. In attempting to correct the problem, it was decided to dig a trench 18 from the top surface or crest of the dike, all the way into the foundation, which would require the trench to be fifty feet deep in some locations, and which would be two feet wide. The trench would be filled with sand, and would also contain plastic geo-membrane vertical panels running from the top surface of the dike 10 to the bottom of the trench 18. The geo-membrane 20, on the upstream side of the trench 18 (the side of the trench nearer the water 14) prevents the water from traversing the cracks in the dike 10 to reach the canal 12, and should the integrity of geo-membrane 20 be compromised, the water will enter the sand-filled trench 18 and be transported by gravity through the length of the trench to a remote location (not illustrated).

The problem then becomes one of preventing the cave-in of the trench walls associated with a trench fifty-feet deep and two feet wide, especially involving the placement of the geo-membrane 20 before the sand can be added to the trench.

I discovered that all of the aforementioned problems related to the use of guar gum are eliminated by using a slurry of partially hydrolyzed polyacrylamide (PHPA), in dry powder form, mixed with fresh water, to fill the trench immediately after digging the trench. The geo-membrane is then put in place, followed by the filling of the trench 18 with sand.

While the PHPA can be rapidly degraded by adding bleach to the trench after filling it with sand, the polymer will bio-degrade in just a few days, which in most cases will eliminate the need to add the bleach.

As an added value, the PHPA slurry will attach to the clay sidewalls of the trench (even though not adhering to the sand particles used to fill the trench), thus creating an additional sealing effect against intrusion of the flood water through the cracks in the dike.

The preferred embodiment of the invention, involving the dry powder PHPA, and marketed by Baroid Drilling Fluids, Inc. of Houston, Tex. under the trademark EZ MUD DP, and being a 100% active PHPA polymer with a molecular weight of ten million, has the following formulation:

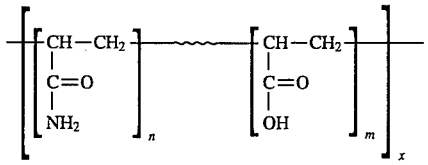

n = 70% and m = 30% or 30% partially hydrolyzed polyacrylamide

Liquid PHPA (not to be confused with merely mixing the dry PHPA product with water) typically is an emulsion product having a high percentage hydrocarbon content, with its concomitant environmental problems, and is generally considered to be extremely sensitive to induced shear, causing it to lose its viscosity. Thus, the preferred embodiment contemplates the use of dry powder PHPA in the slurry used to fill the trench.

Figure 2:
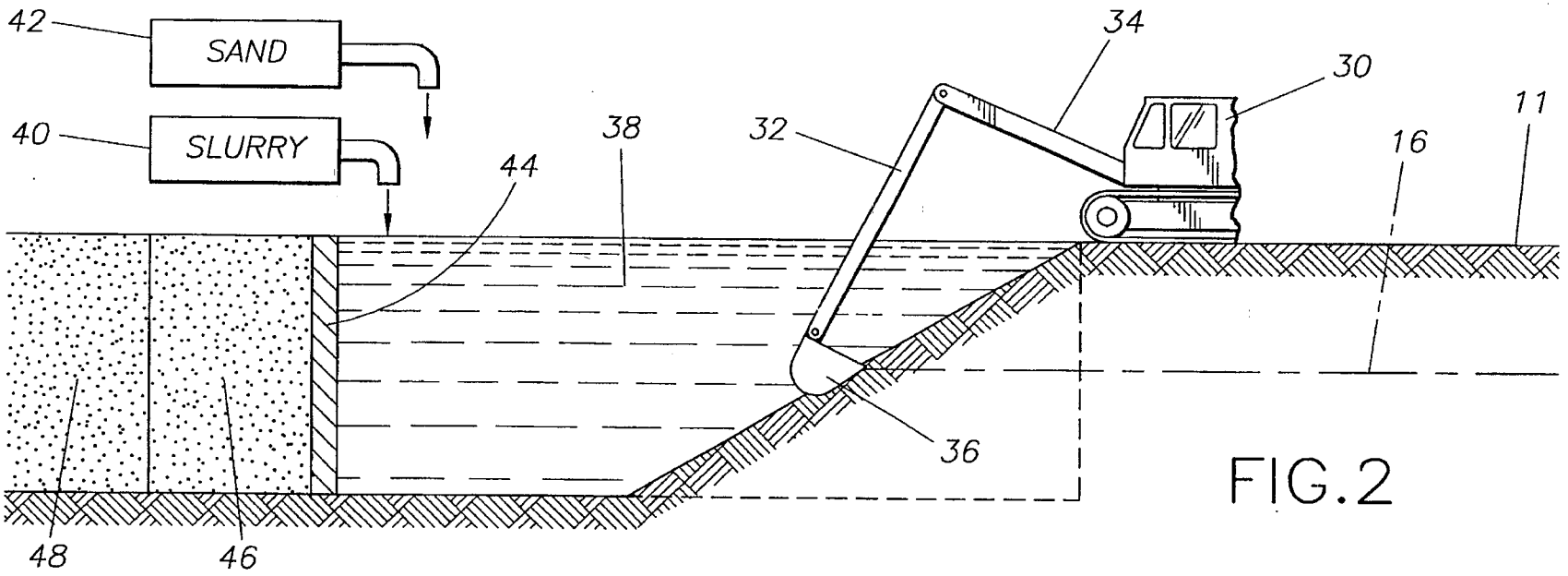
FIG. 2 is a side elevational, cross-sectional, schematic view of the process for excavating and filling a trench in according with the present invention.

FIG. 2 illustrates, schematically, a back hoe 30 or other conventional slurry trench excavating equipment in the context of forming the trench 18 of FIG. 1. The length of arms 32 and 34 are selected to provide a means for ensuring the depth of trench 18 up to fifty feet, with the width of the hoe 36 being selected to provide a width of two feet for the trench 18.

The slurry 38 prepared in accordance with the present invention is pumped into the trench 18 continuously as the back hoe 30 continues to dig the trench 18. The slurry 38 is pumped into the trench 18 from the slurry unit 40, consisting of a hopper for mixing the dry powder PHPA with fresh water, combined with a conventional slurry pumping unit. It should be appreciated that the slurry unit 40 and the sand pumping unit 42 can be conveniently located either on the upper surface 11 of the dike 10, or can be located on the ground level 16, if desired. The sand pumping unit 42 consists of a hopper for holding the dry sand and a conventional sand pumping unit for pumping the sand into the slurry-filled trench 18.

As a given length of trench 18 is excavated, a two-foot wide barrier 44 is placed in the trench 18 on a temporary basis to completely seal off, or at least approximately seal off one section of the trench from the next. A section 46 of the geo-membrane 20 is lowered into the slurry-filled trench and is connected to an adjoining section 48 of the geo-membrane 20. The barrier 44 is then removed and dry sand is then pumped into the trench 18 until the excavated trench 18 up to about the point where barrier 44 had been is full of sand.

Figure 3:
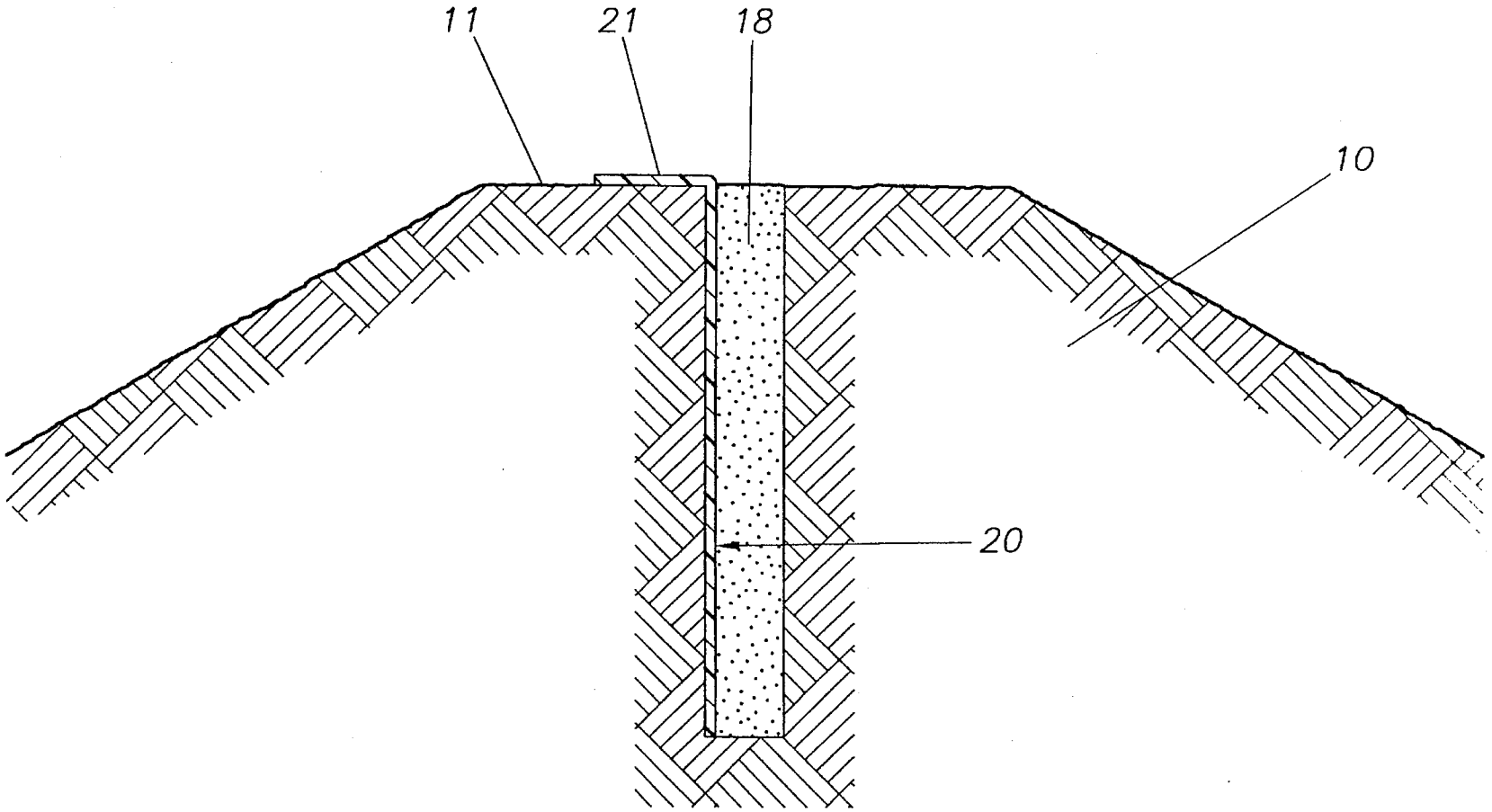
FIG. 3 is an expanded version of the dike illustrated in FIG. 1.

FIG. 3 illustrates, in an expanded cross-sectional view, the sand-filled trench 18, having its geo-membrane 20 extending to the depth of the trench, but extending at its top end 21 over onto the top surface 11 of the dike 10. After the section of the geo-membrane 20 is in place, as illustrated in FIG. 3, the sand is then pumped into the trench to completely fill the trench. Sand is then added over the top 21 of the membrane 20 to assist in keeping it in place.

In practicing the present invention, it is preferred that the slurry be prepared in a ratio as follows:

a) 20 pounds of dry powder PHPA;

b) 2,856 gallons (68 barrels) of fresh water; and c) 4 pounds of soda ash (sodium carbonate).

The preferred mixing procedure is as follows:

1. Add pre-weighed dry polymer and soda ash simultaneously through the hopper and mix with fresh water through a jet underneath the hopper.
2. Pump the polymer/water mixture to the mixing tank using a centrifuge pump. The addition is completed when a total of 68 barrels of fresh water is charged from one of three frac tanks to the mixing tank.
3. Turn off the centrifugal pump and continue mixing the polymer/water mixture using only two large paddles in the mixing tank.
4. Continue to mix for 15 minutes until no dry polymer can be seen in the polymer slurry. Additional mixing time may be needed if there is some dry polymer not yet dispersed. (Note: Most of the time it should not take more than 20 minutes to disperse 20 pounds of dry polymer.)
5. Measure funnel viscosity of the polymer slurry with a standard Marsh funnel viscometer. The funnel viscosity should preferably be at least 45 sec/quart or higher.

Because PHPA polymer do exhibit some degree of reduced viscosity when subjected to high shear forces, the pump is turned off and only the two large paddles are used in the mixing tank, although it should be noted that a mixture of fresh water with dry PHPA does not have the same reduction of viscosity as is experienced When subjecting liquid PHPA to high shear forces.

For as yet unknown reasons, some commercially available dry powder PHPA products will have a funnel viscosity of less than 45 sec/quart when mixing 20 pounds of the polymer with 68 barrels of fresh water, so it is a good practice to laboratory test any particular PHPA before using it in the field as a trench slurry as contemplated by the present invention. If a suitable PHPA can not be found which produces a funnel viscosity of at least 45 sec/quart, when using 20 pounds of dry PHPA with 68 barrels of water, then the relative volume of PHPA can be increased to raise the viscosity. If additional polymer is added to increase the funnel viscosity, it should be added through the hopper instead of adding directly into the mixing tank.

Moreover, the water should indeed be "fresh water", not brine water, having a total chloride (Cl) content of less than 1000 ppm. The hardness of the water should be controlled (softened) by the addition of the soda ash in the amount of approximately 4 lbs per 20 lbs of PHPA powder. The total chlorine ($Cl_2$) content should be less than 100 ppm. The water pH is preferably maintained between 7 and 10, and the water temperature should preferably not exceed 150° F. (65° C.).

What is claimed is:

1. A method of minimizing cave-in of an excavated earthen cavity, comprising:

preparing a slurry comprised of water and partially hydrolyzed polyacrylamide polymer;

mixing the slurry to fully hydrate the partially hydrolyzed polyacrylamide polymer;

forming an impermeable barrier against an upstream sidewall of the excavated earthen cavity;

filling the excavated earthen cavity with the slurry to coat a wall of the excavated earthen cavity; and adding sand to the slurry filled cavity to selectively displace the slurry.

2. The method according to claim 1, wherein the step of preparing the slurry further comprises:

mixing the partially hydrolyzed polyacrylamide polymer with fresh water in a ratio of from about 0.08% to 0.017% by weight of the slurry.

3. The method according to claim 2, wherein the fresh water has a chlorine content of less than 100 ppm.

4. The method according to claim 1, further comprising:

adding soda ash to the slurry.

5. The method according to claim 1, wherein forming the impermeable barrier comprises placing a geomembrane against the upstream sidewall.

6. The method according to claim 1, further comprising:

after filling the earthen cavity with the slurry, adding a sodium hydrochloride solution to the slurry to chemically degrade the slurry.

7. The method as defined in claim 1, wherein the impermeable barrier is formed after filling the excavated earthen cavity with the slurry.

8. A method of minimizing cave-in of an excavated earthen cavity, comprising:

preparing a slurry comprised of fresh water and partially hydrolyzed polyacrylamide polymer;

controlling the amount of partially hydrolyzed polyacrylamide polymer combined with the fresh water to provide the slurry with a funnel viscosity of at least 45 sec/quart;

forming an impermeable barrier against an upstream sidewall of the excavated earthen cavity;

filling the earthen cavity with the slurry; and adding sand to the slurry filled cavity to selectively displace the slurry.

9. The method according to claim 8, wherein the fresh water has a total chloride content of less than 1000 ppm.

10. The method according to claim 8, further comprising:

adding soda ash to the slurry to control the hardness of the fresh water.

11. The method according to claim 8, wherein the pH of the fresh water is maintained between 7 and 10, and the fresh water temperature is less than 65° C.

12. The method according to claim 8, wherein the chlorine content of the fresh water is maintained at or below 100 ppm.

13. The method according to claim 8, wherein forming the impermeable barrier comprises placing a geo-membrane against the upstream sidewall.

14. The method according to claim 8, further comprising:

after filling the earthen cavity with the slurry, adding a sodium hydrochloride solution to the slurry to degrade the slurry.

15. The method as defined in claim 8, wherein the impermeable barrier is formed after filling the excavated earthen cavity with the slurry.

16. A method of minimizing cave-in of an excavated earthen cavity, comprising:

preparing a slurry comprised of fresh water, dry powdered partially hydrolyzed polyacrylamide polymer, and soda ash;

controlling the amount of dry powdered partially hydrolyzed polyacrylamide polymer to provide the slurry with a funnel viscosity of at least 45 sec/quart;

filling the earthen cavity with the slurry; and thereafter forming a mechanical barrier in the excavated earthen cavity to prevent cave-in.

17. The method according to claim 16, where the fresh water has a total chloride content of less than 1000 ppm.

18. The method according to claim 16, wherein the pH of the fresh water is maintained between 7 and 10, and the fresh water temperature is less than 65° C.

19. The method as defined in claim 16, further comprising:

adding sand to the slurry filled cavity to selectively displace the slurry.

* * * * *